US008961251B1

(12) United States Patent
Lewis et al.

(10) Patent No.: US 8,961,251 B1
(45) Date of Patent: Feb. 24, 2015

(54) SWIMMING DEVICE FOR INCREASED UNDERWATER RESISTANCE

(71) Applicants: Donald J. Lewis, Welland, CA (US); Daniel S. Bowes, Welland, CA (US)

(72) Inventors: Donald J. Lewis, Welland, CA (US); Daniel S. Bowes, Welland, CA (US)

( * ) Notice: Subject to any disclaimer, the term of this patent is extended or adjusted under 35 U.S.C. 154(b) by 0 days.

(21) Appl. No.: 13/932,769

(22) Filed: Jul. 1, 2013

(51) Int. Cl.
*A63B 31/02* (2006.01)
*A63B 31/04* (2006.01)
*A63B 31/11* (2006.01)

(52) U.S. Cl.
CPC ..... *A63B 31/04* (2013.01); *A63B 31/11* (2013.01)
USPC ..... 441/57; 441/58; 441/60

(58) Field of Classification Search
USPC ..... 441/56, 57, 60, 64, 58
IPC ..... A63B 31/08
See application file for complete search history.

(56) References Cited

U.S. PATENT DOCUMENTS

| | | | | |
|---|---|---|---|---|
| 2,898,611 | A | 8/1959 | Mooney | |
| 3,263,248 | A * | 8/1966 | Wendorf | 441/57 |
| 4,345,335 | A | 8/1982 | Shih-Li | |
| 4,721,300 | A | 1/1988 | Guzman | |
| D310,255 | S | 8/1990 | Gammon | |
| 5,087,217 | A * | 2/1992 | Tuan et al. | 441/61 |
| 5,330,377 | A * | 7/1994 | Kernek | 441/64 |
| 5,641,316 | A * | 6/1997 | Bakalis | 441/57 |
| D416,601 | S | 11/1999 | Gurley | |
| 7,614,928 | B2 * | 11/2009 | Grivna | 441/61 |
| 2002/0077010 | A1 | 6/2002 | Lukas | |
| 2005/0186865 | A1 | 8/2005 | Harwell | |
| 2009/0280703 | A1 * | 11/2009 | Rachels | 441/57 |
| 2012/0017352 | A1 | 1/2012 | Waddell | |

* cited by examiner

*Primary Examiner* — Stephen Avila

(57) ABSTRACT

A swimming device for increased underwater resistance increases resistance while underwater for purposes of rehabilitation and fitness. The device includes a glove having a main portion and a plurality of finger portions and a thumb portion whereby the glove is configured for covering a human hand. A channel-forming member has a peripheral wall extending upwardly from the main portion of the glove and a top wall extending between a first side and a second side of the peripheral wall. The channel-forming member has a pair of separator portions extending downwardly from the peripheral wall wherein the separator portions are configured for separating the channel-forming member into a plurality of channels. A pair of fins is coupled to the channel-forming member wherein the fins and the channels are configured for increasing underwater resistance when the glove is positioned on the hand and moved underwater.

19 Claims, 5 Drawing Sheets

SWIMMING DEVICE FOR INCREASED UNDERWATER RESISTANCE

BACKGROUND OF THE DISCLOSURE

Field of the Disclosure

The disclosure relates to swimming devices and more particularly pertains to a new swimming device for increasing underwater resistance for rehabilitation or fitness purposes.

SUMMARY OF THE DISCLOSURE

An embodiment of the disclosure meets the needs presented above by generally comprising a glove having a main portion and a plurality of finger portions and a thumb portion whereby the glove is configured for covering a human hand. A channel-forming member has a peripheral wall extending upwardly from the main portion of the glove and a top wall extending between a first side and a second side of the peripheral wall. The channel-forming member has a pair of separator portions extending downwardly from the peripheral wall wherein the separator portions are configured for separating the channel-forming member into a plurality of channels. A pair of fins is coupled to the channel-forming member wherein the fins and the channels are configured for increasing underwater resistance when the glove is positioned on the hand and moved underwater.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
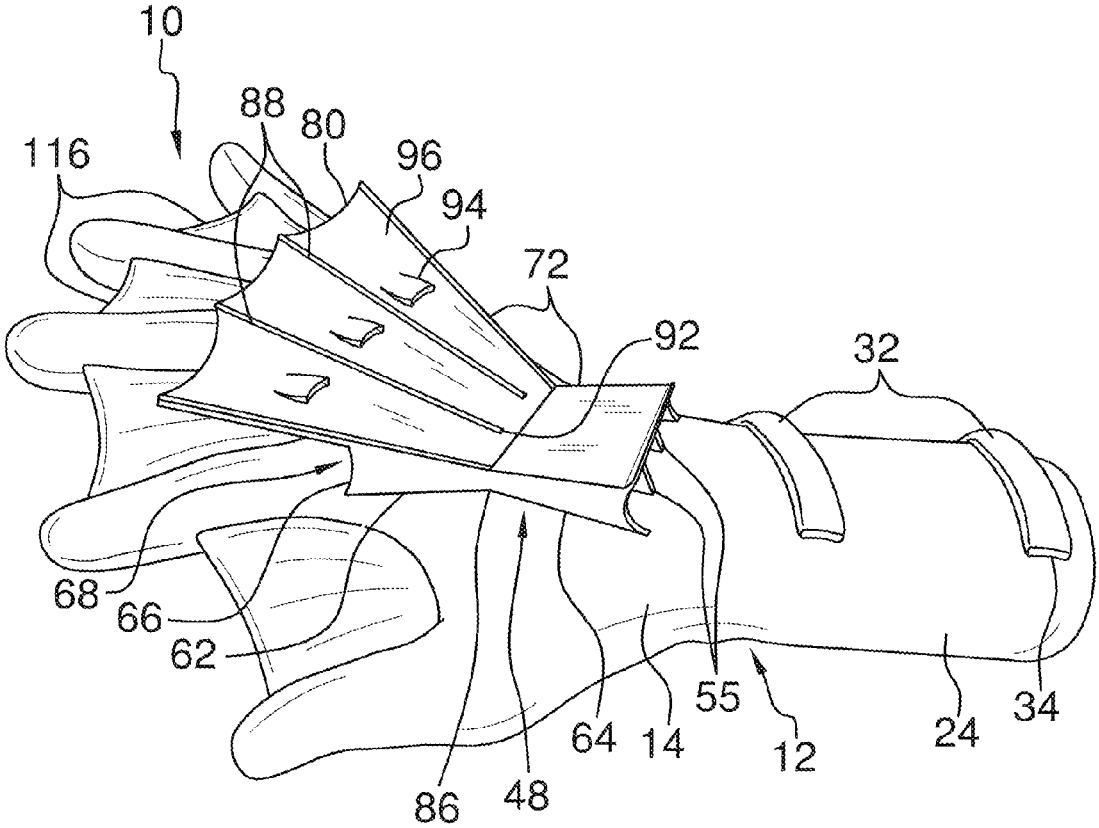
FIG. 1 is a top front side perspective view of a swimming device for increased underwater resistance according to an embodiment of the disclosure.
Figure 2:
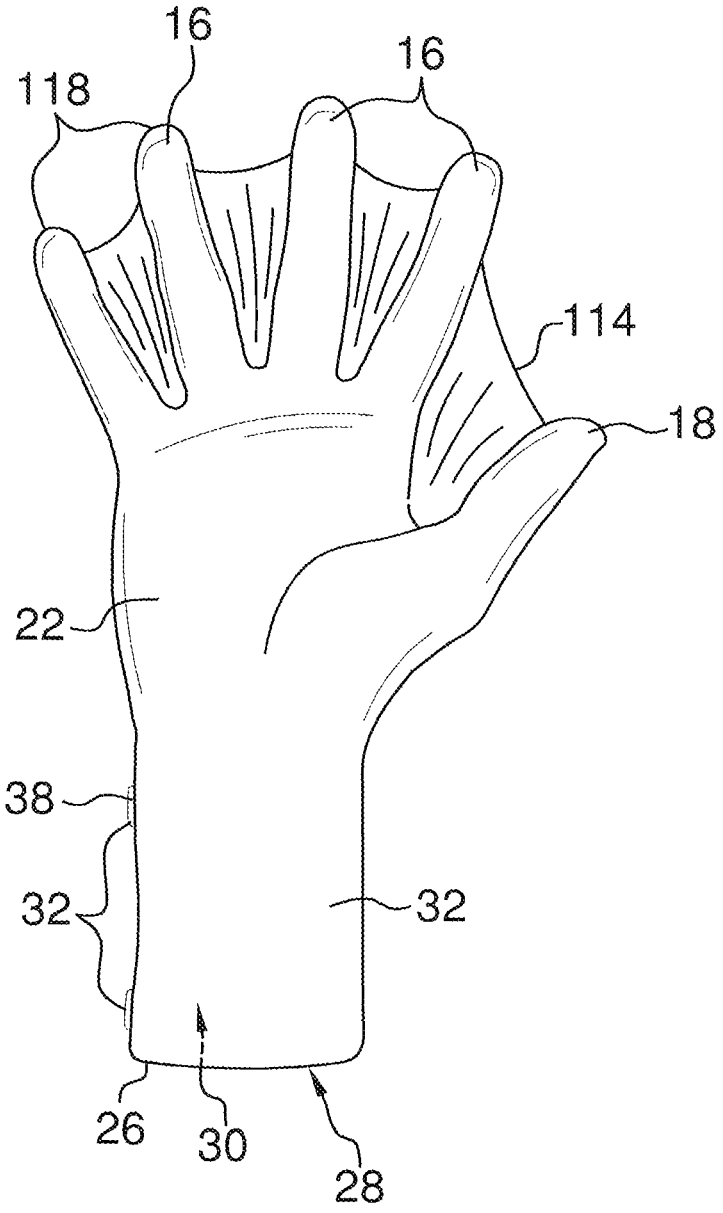
FIG. 2 is a bottom view of an embodiment of the disclosure.
Figure 3:
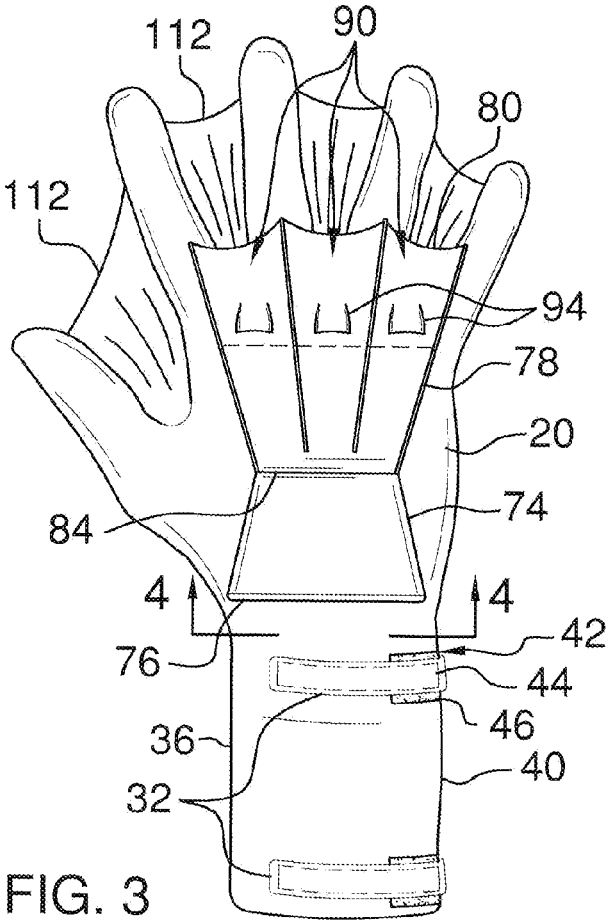
FIG. 3 is a top view of an embodiment of the disclosure.
Figure 4:
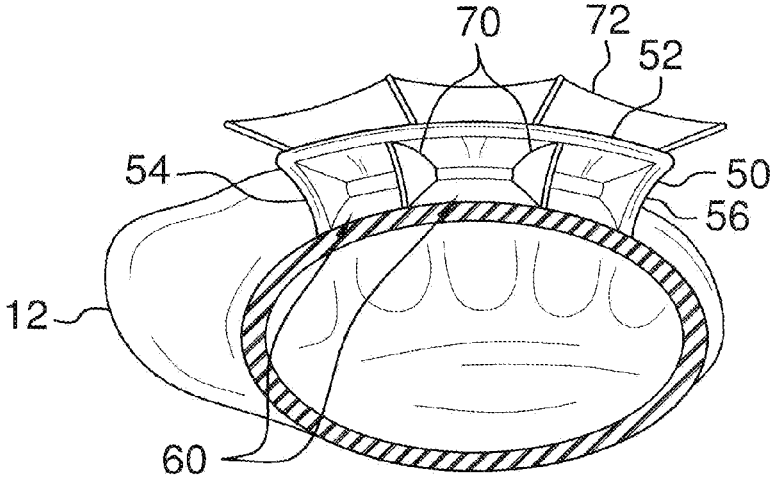
FIG. 4 is a cross-sectional view of an embodiment of the disclosure taken along line 4-4 of FIG. 3.
Figure 5:
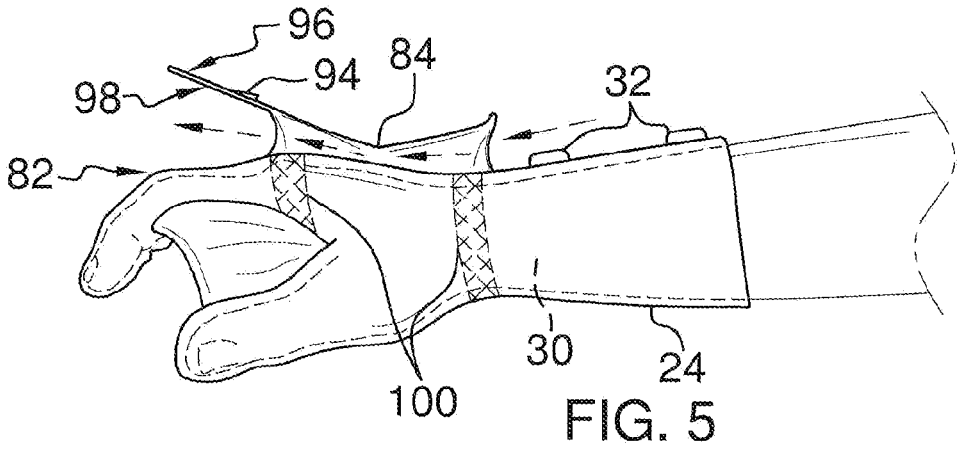
FIG. 5 is a side view of an embodiment of the disclosure.

With reference now to the drawings, and in particular to FIGS. 1 through 6A thereof, a new swimming device embodying the principles and concepts of an embodiment of the disclosure and generally designated by the reference numeral 10 will be described.

As best illustrated in FIGS. 1 through 6A, the swimming device for increased underwater resistance 10 generally comprises a glove 12 having a main portion 14 and a plurality of finger portions 16 and a thumb portion 18 whereby the glove 12 is configured for covering a human hand. The glove 12 has a top side 20 opposite a bottom side 22. A cuff portion 24 is preferably provided and extends from the main portion 14 of the glove 12 such that the cuff portion 24 is configured for positioning adjacent a wrist when the hand is inserted into the glove 12. The glove 12 is preferably a gauntlet-style glove that extends past the wrist and onto a forearm of the wearer. A bottom edge 26 of the cuff portion 24 defines an opening 28 into an interior 30 of the glove 12. The glove 12 is preferably constructed of a water-resistant or water-compatible material.

A pair of exterior straps 32 is removably coupled to the cuff portion 24. The exterior straps 32 are preferably positioned on the top side 20 of the glove 12. A first side 34 of each of the exterior straps 32 may be offset from a first lateral side 36 of the cuff portion 24. A second side 38 of each of the exterior straps 32 is coupled to a second lateral side 40 of the cuff portion 24. A fastener 42 couples each of the exterior straps 32 to the cuff portion 24. Each of the fasteners 42 may comprise complementary portions 44, 46 of hoop and loop fastener. Each of the complementary portions 44, 46 of hook and loop fastener is preferably an elongated strip. One of the complementary portions 44 of hook and loop fastener is coupled to the exterior strap 32. One of the complementary portions 46 of hook and loop fastener is coupled to the cuff portion 24 such that the exterior strap 32 is couplable to the cuff portion 24 when complementary portions 44, 46 of hook and loop fastener are selectively engaged. In this manner, the glove 12 is adjustable so as to be form-fitting and securely maintained on a wearer's hand. Each of the exterior straps 32 is preferably constructed from nylon, though other suitable materials are also within the scope of the invention.

A channel-forming member 48 has a peripheral wall 50 extending upwardly from the main portion 14 of the glove 12 and a top wall 52 extending between a first side 54 and a second side 56 of the peripheral wall 50. The channel-forming member 48 has a pair of separator portions 58 extending downwardly from the peripheral wall 50 and coupled to the main portion 14 of the glove 12 wherein the separator portions 58 are configured for separating the channel-forming member 48 into a plurality of channels 60. The channel-forming member 48 is preferably positioned on the top side 20 of the glove 12 for increased strength. The channel-forming member 48 has a first portion 62 coupled to a second portion 64. The second portion 64 is positioned nearer the cuff portion 24 than the first portion 62. A first end 66 of the first portion 62 may be coupled to a lower end 68 of the finger portions 16 of the glove 12. A plurality of stiffeners 70 is preferably positioned in the channels 60 wherein the stiffeners 70 are configured to retain the shape of each of the channels 60. Channels 60 may also be provided on the finger portions 16 to increase resistance when the glove 12 is worn underwater. The channels 60 preferably taper outwardly such that the channels 60 are widest proximate the cuff portion 24 in order to increase the ability of the channels 60 to capture water therein.

A pair of fins 72 is coupled to the channel-forming member 48 wherein the fins 72 and the channels 60 are configured for increasing underwater resistance when the glove 12 is positioned on the hand of a wearer and the hand is moved underwater. The fins 72 are coupled to the top wall 52 of the channel-forming member 48. The fins 72 may be slanted upwardly relative to the top side 20 of the main portion 14 of the glove 12. A first one 74 of the fins 72 may have an outer edge 76 aligned with the separator portions 58 of the second portion 64 of the channel-forming member 48. A second one 78 of the fins 72 preferably has an outer edge 80 positioned proximate knuckles 82 of a wearer when the glove 12 is positioned on the hand of the wearer. The second one 78 of the fins 72 may extend between approximately 1.0 centimeter and 3.5 centimeters past the knuckles 82 when the hand is positioned in the glove 12. The outer edge 80 of the second one 78 of the fins 72 may be concavely arcuate. The first one 74 of the fins 72 is coupled to the second one 78 of the fins 72 at an inner edge 84 positioned above a juncture 86 joining the first portion 62 to the second portion 64 of the channel-forming member 48. The first one 74 of the fins 72 may be smaller than the second one 78 of the fins 72. Each of the fins 72 preferably tapers outwardly relative to the main portion 14 of the glove 12. The second one 78 of the fins 72 has a pair of dividers 88 extending outwardly therefrom wherein the dividers 88 are configured for separating the second one 78 of the fins 72 into a plurality of fin portions 90. A bottom edge 92 of the dividers 88 may be offset from the inner edge 84. A vent 94 preferably extends into each of the fin portions 90 wherein each of the vents 94 is configured for permitting water to pass between an upper side 96 and a lower side 98 of the second one 78 of the fins 72. Each of the fins 72 and the channels 62 may be adjustable or may be provided in different sizes so that a wearer may select a desired resistance level.

A plurality of reinforcing straps 100 may be coupled to the interior 30 of the glove 12. Each of the reinforcing straps 100 is coupled to and extends across an upper side 102 of the interior 30 of the glove 12. One of the reinforcing straps 100 is preferably positioned adjacent the thumb portion 18 and below the finger portions 16. One of the reinforcing straps 100 is preferably coupled to the cuff portion 24 above an upper one 104 of the exterior straps 32. One of the reinforcing straps 100 is preferably coupled to the cuff portion 24 and is positioned between the upper one 104 and a lower one 106 of the exterior straps 32. Supplementary fins 108 and supplementary channel-forming members 110 may be provided and are positionable above each of the reinforcing straps 100.

A plurality of webs 112 is provided. The webs 112 comprise a thumb web 114 and a plurality of finger webs 116. The thumb web 114 is coupled to and extends between the thumb portion 18 and an adjacent one of the finger portions 16. The finger webs 116 are coupled to and extend between adjacent ones of the finger portions 16. Each of the webs 112 may be offset from a fingertip section 118 of the finger portions 16. Each of the webs 112 has composite supports positioned therein to provide structural stability to the webs 112. The composite supports are preferably constructed from molded plastic, such as polyethylene or polyvinyl chloride, and may be injection-molded or melted into the webs 112. Each of the channels 60, fins 72, and webs 112 is preferably constructed from rubber, such as neoprene, silicone-based composites, or the like.

Figure 6:
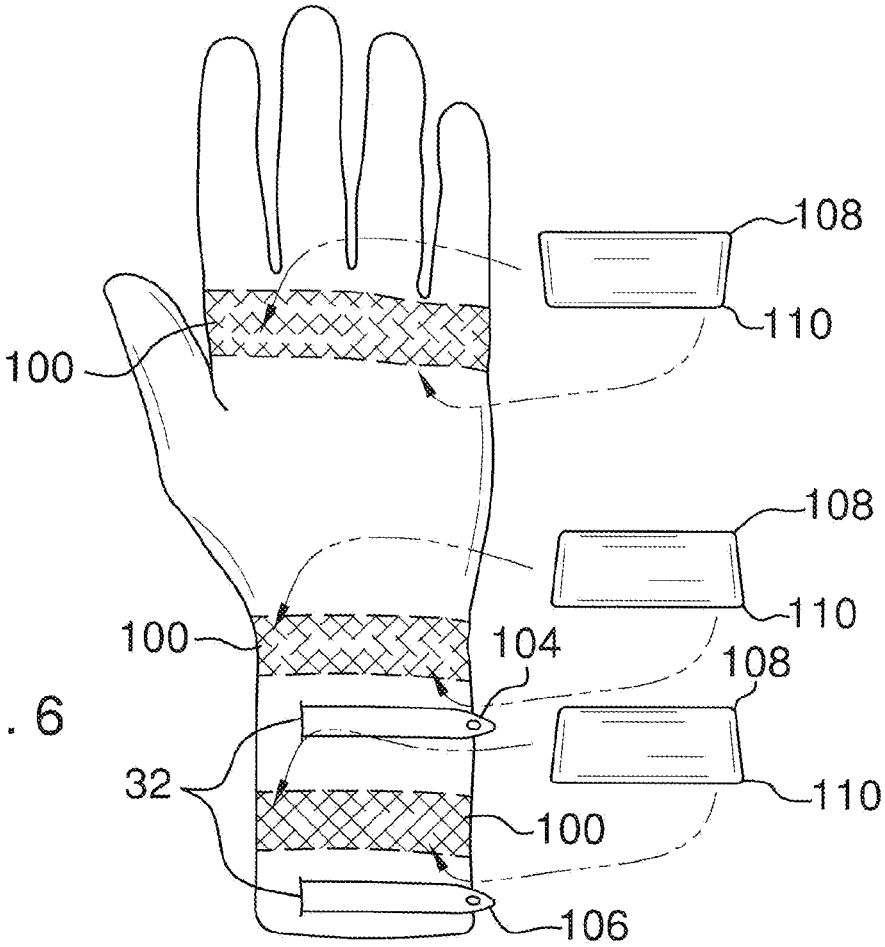
FIG. 6 is a top view of an embodiment of the disclosure.
Figure 6A:
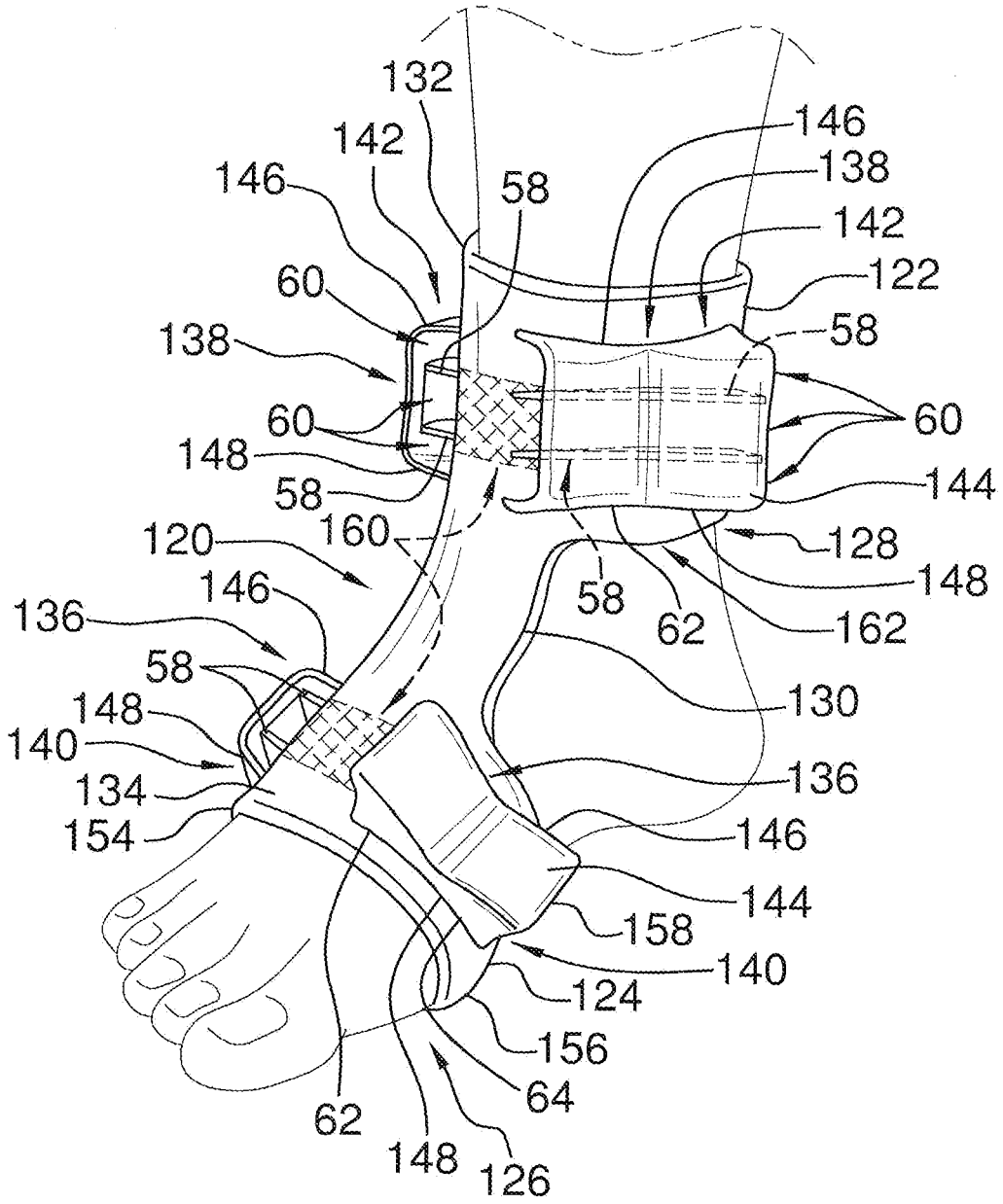
FIG. 6A is a top front side perspective view of an embodiment of the disclosure.

FIG. 6A shows an alternate embodiment of the present invention in the form of an anklet 120. As shown, the anklet 120 has an ankle portion 122 and a foot portion 124 whereby the anklet 120 is configured for positioning around a human foot 126 and a corresponding ankle 128. In this manner, the anklet 120 is similar to that of an ankle brace. Each of the ankle portion 122 and the foot portion 124 is preferably annular. The anklet 120 further has a medial portion 130 extending between a top side 132 of the ankle portion 122 and a top side 134 of the foot portion 124.

As further shown in FIG. 6A, a first set 136 and a second set 138 of channel-forming members 48 is provided. Each of the first set 136 of channel-forming members 48 has a peripheral wall 140 extending outwardly from the ankle portion 122 of the anklet 120. Each of the second set 138 of channel-forming members 48 has a peripheral wall 142 extending outwardly from the foot portion 124 of the anklet 120. Each of the channel-forming members 136, 138 has a top wall 144 extending between a first side 146 and a second side 148 of each of an associated one of the peripheral walls 140, 142. Each of the channel-forming members 136, 138 has a pair of separator portions 58 extending downwardly from the top wall 144 and coupled to an associated one of the ankle portion 122 and the foot portion 124 wherein the separator portions 58 are configured for separating the channel-forming members 136, 138 into a plurality of channels 60. Each of the first set 136 of channel-forming members 48 is preferably positioned on an associated one of a first side 150 and a second side 152 of the ankle portion 122. Likewise, each of the second set 138 of channel-forming members 48 is preferably positioned on an associated one of a first side 154 and a second side 156 of the foot portion 124. Each of the channel-forming members 136, 138 has a first portion 62 coupled to a second portion 64.

A pair of reinforcing straps 160 may be coupled to an interior 162 of the anklet 120. One of the reinforcing straps 160 is preferably coupled to and extends across the top side 132 of the ankle portion 122. One of the reinforcing straps 160 is preferably coupled to and extends across the top side 134 of the foot portion 124.

In use, as stated above and shown in the Figures, the glove 12, the anklet 120, or both are positioned on the wearer's hand and ankle 128, respectively. Either one or two of the gloves 12 or one or two of the anklets 120 may be used. A wearer then engages in aquatic exercise or rehabilitation training by moving his hands, arms, legs, and/or feet. The webs 112, channels 60, and fins 72 provide increased resistance against the water in order to strengthen and tone the muscles in the wearer's upper and lower body. The water resistance is proportional to the speed and force of a wearer's movements. Thus, the greater speed or force with which the wearer moves while wearing the glove 12 or anklet 120 under water, the greater water resistance the wearer must overcome in order to achieve those movements.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swimming device for increased underwater resistance comprising:

a glove having a main portion and a plurality of finger portions and a thumb portion whereby said glove is configured for covering a human hand;

a channel-forming member having a peripheral wall extending upwardly from said main portion of said glove and a top wall extending between a first side and a second side of said peripheral wall, said channel-forming member having a pair of separator portions extending downwardly from said top wall of said channel-forming member and being coupled to said main portion of said glove wherein said separator portions are configured for separating said channel-forming member into a plurality of channels;

a pair of fins coupled to said channel-forming member wherein said fins and said channels are configured for increasing underwater resistance when said glove is positioned on a hand of a wearer and the hand is moved underwater;

a cuff portion extending from said main portion of said glove such that said cuff portion is configured for positioning adjacent a wrist when the hand is inserted into said glove; and a pair of exterior straps coupled to said cuff portion, said exterior straps being positioned on a top side of said glove.

2. The device of claim 1, further comprising a first side of each of said exterior straps being offset from a first lateral side of said cuff portion, a second side of each of said exterior straps being coupled to a second lateral side of said cuff portion.

3. The device of claim 1, further comprising said exterior straps being removably coupled to said cuff portion.

4. The device of claim 3, further comprising a fastener coupling each of said exterior straps to said cuff portion.

5. The device of claim 4, further comprising each of said fasteners being complementary portions of hoop and loop fastener, each of said complementary portions of hook and loop fastener being an elongated strip, one of said complementary portions of hook and loop fastener being coupled to said exterior strap, one of said complementary portions of hook and loop fastener being coupled to said cuff portion such that said exterior strap is couplable to said cuff portion when complementary portions of hook and loop fastener are selectively engaged.

6. The device of claim 1, further comprising said channel-forming member being positioned on a top side of said glove.

7. The device of claim 1, further comprising said channel-forming member having a first portion coupled to a second portion, said second portion being positioned nearer said cuff portion than said first portion, a first end of said first portion being coupled to a lower end of said finger portions of said glove.

8. The device of claim 1, further comprising a plurality of stiffeners being positioned in said channels wherein said stiffeners are configured to retain the shape of each of said channels.

9. The device of claim 1, further comprising said fins being coupled to said top wall of said channel-forming member.

10. The device of claim 1, further comprising said fins being slanted upwardly relative to a top side of said main portion of said glove.

11. A swimming device for increased underwater resistance comprising:

a glove having a main portion and a plurality of finger portions and a thumb portion whereby said glove is configured for covering a human hand;

a channel-forming member having a peripheral wall extending upwardly from said main portion of said glove and a top wall extending between a first side and a second side of said peripheral wall, said channel-forming member having a pair of separator portions extending downwardly from said top wall of said channel-forming member and being coupled to said main portion of said glove wherein said separator portions are configured for separating said channel-forming member into a plurality of channels, said channel-forming member having a first portion coupled to a second portion, said second portion being positioned nearer a cuff portion than said first portion, a first end of said first portion being coupled to a lower end of said finger portions of said glove;

a pair of fins coupled to said channel-forming member wherein said fins and said channels are configured for increasing underwater resistance when said glove is positioned on a hand of a wearer and the hand is moved underwater; and a first one of said fins having an outer edge aligned with said separator portions of said second portion of said channel-forming member, a second one of said fins having an outer edge being positioned proximate knuckles of a wearer when said glove is positioned on the hand of the wearer.

12. The device of claim 11, further comprising said first one of said fins being coupled to said second one of said fins at an inner edge positioned above a juncture joining said first portion and said second portion of said channel-forming member.

13. The device of claim 11, further comprising said outer edge of said second one of said fins being concavely arcuate, each of said fins tapering outwardly relative to said main portion of said glove.

14. The device of claim 1, further comprising a plurality of webs, said webs comprising a thumb web and a plurality of finger webs, said thumb web being coupled to and extending between said thumb portion and an adjacent one of said finger portions, said finger webs being coupled to and extending between adjacent ones of said finger portions, each of said webs being offset from a fingertip section of said finger portions.

15. The device of claim 11, further comprising said second one of said fins having a pair of dividers extending outwardly therefrom wherein said dividers are configured for separating said second one of said fins into a plurality of fin portions.

16. The device of claim 15, further comprising a vent extending into each of said fin portions wherein each of said vents is configured for permitting water to pass between an upper side and a lower side of said second one of said fins.

17. The device of claim 1, further comprising:

a plurality of reinforcing straps coupled to an interior of said glove, each of said reinforcing straps being coupled to and extending across an upper side of said glove, one of said reinforcing straps being positioned adjacent said thumb portion and below said finger portions, one of said reinforcing straps being coupled to said cuff portion above an upper one of said exterior straps, one of said reinforcing straps being coupled to said cuff portion and being positioned between said upper one and a lower one of said exterior straps; and supplementary fins and supplementary channel-forming members being positioned above each of said reinforcing straps.

18. The device of claim 1, further comprising:

said glove having a top side opposite a bottom side;

a bottom edge of said cuff portion defining an opening into an interior of said glove;

said pair of exterior straps being removably coupled to said cuff portion, a first side of each of said exterior straps being offset from a first lateral side of said cuff portion, a second side of each of said exterior straps being coupled to a second lateral side of said cuff portion;

a fastener coupling each of said exterior straps to said cuff portion, each of said fasteners being complementary portions of hoop and loop fastener, each of said complementary portions of hook and loop fastener being an elongated strip, one of said complementary portions of hook and loop fastener being coupled to said exterior strap, one of said complementary portions of hook and loop fastener being coupled to said cuff portion such that said exterior strap is couplable to said cuff portion when complementary portions of hook and loop fastener are selectively engaged;

said channel-forming member being positioned on said top side of said glove, said channel-forming member having a first portion coupled to a second portion, said second portion being positioned nearer said cuff portion than said first portion, a first end of said first portion being coupled to a lower end of said finger portions of said glove;

a plurality of stiffeners being positioned in said channels wherein said stiffeners are configured to retain the shape of each of said channels;

said fins being coupled to said top wall of said channel-forming member, said fins being slanted upwardly relative to said top side of said main portion of said glove, a first one of said fins having an outer edge aligned with said separator portions of said second portion of said channel-forming member, a second one of said fins having an outer edge being positioned proximate knuckles of a wearer when said glove is positioned on the hand of the wearer, said outer edge of said second one of said fins being concavely arcuate, said first one of said fins being coupled to said second one of said fins at an inner edge positioned above a juncture joining said first portion to said second portion of said channel-forming member, said first one of said fins being smaller than said second one of said fins, each of said fins tapering outwardly relative to said main portion of said glove, said second one of said fins having a pair of dividers extending outwardly therefrom wherein said dividers are configured for separating said second one of said fins into a plurality of fin portions, a bottom edge of said dividers being offset from said inner edge;

a vent extending into each of said fin portions wherein each of said vents is configured for permitting water to pass between an upper side and a lower side of said second one of said fins;

a plurality of reinforcing straps coupled to said interior of said glove, each of said reinforcing straps being coupled to and extending across an upper side of said glove, one of said reinforcing straps being positioned adjacent said thumb portion and below said finger portions, one of said reinforcing straps being coupled to said cuff portion above an upper one of said exterior straps, one of said reinforcing straps being coupled to said cuff portion and being positioned between said upper one and a lower one of said exterior straps;

supplementary fins and supplementary channel-forming members being positioned above each of said reinforcing straps; and a plurality of webs, said webs comprising a thumb web and a plurality of finger webs, said thumb web being coupled to and extending between said thumb portion and an adjacent one of said finger portions, said finger webs being coupled to and extending between adjacent ones of said finger portions, each of said webs being offset from a fingertip section of said finger portions.

19. A swimming device for increased underwater resistance comprising:

an anklet having an ankle portion and a foot portion whereby said anklet is configured for positioning around a human foot and a corresponding ankle, each of said ankle portion and said foot portion being annular, said anklet further having a medial portion extending between a top side of said ankle portion and a top side of said foot portion;

a first set of channel-forming members and a second set of channel-forming members, each of said first set of channel-forming members having a peripheral wall extending outwardly from said ankle portion of said anklet, each of said second set of channel-forming members having a peripheral wall extending outwardly from said foot portion of said anklet, each of said channel-forming members having a top wall extending between a first side and a second side of each of an associated one of said peripheral walls of said channel-forming members, each of said channel-forming members having a pair of separator portions extending downwardly from said top wall of said channel-forming members and being coupled to an associated one of said ankle portion and said foot portion wherein said separator portions are configured for separating said channel-forming members into a plurality of channels, each of said first set of channel-forming members being positioned on an associated one of a first side and a second side of said ankle portion, each of said second set of channel-forming members being positioned on an associated one of a first side and a second side of said foot portion, said channel-forming member having a first portion coupled to a second portion; and a pair of reinforcing straps coupled to an interior of said anklet, one of said reinforcing straps being coupled to and extending across said top side of said ankle portion, one of said reinforcing straps being coupled to and extending across said top side of said foot portion.

* * * * *